US009856114B2

(12) United States Patent
Lampinen

(10) Patent No.: US 9,856,114 B2
(45) Date of Patent: Jan. 2, 2018

(54) ELEVATOR

(71) Applicant: Riku Lampinen, Helsinki (FI)

(72) Inventor: Riku Lampinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 290 days.

(21) Appl. No.: 14/665,858

(22) Filed: Mar. 23, 2015

(65) Prior Publication Data

US 2015/0298939 A1 Oct. 22, 2015

(30) Foreign Application Priority Data

Apr. 16, 2014 (EP) ..... 14164857

(51) Int. Cl.
*B66B 7/06* (2006.01)
*B66B 7/10* (2006.01)

(52) U.S. Cl.
CPC ..... *B66B 7/068* (2013.01)

(58) Field of Classification Search
CPC ..... B66B 7/068; B66B 7/10
See application file for complete search history.

(56) References Cited

U.S. PATENT DOCUMENTS 1,944,772 A * 1/1934 White ..... B66B 7/068 187/265
2,270,441 A 1/1942 Hymans
4,230,205 A * 10/1980 Darwent ..... B66B 7/068 187/265
4,522,285 A 6/1985 Salmon et al.
(Continued)

FOREIGN PATENT DOCUMENTS

CN 201415903 Y 3/2010
JP 51143239 A 12/1976
(Continued)

OTHER PUBLICATIONS

European Search Report from Application No. 14 164 857.6 dated Oct. 3, 2014.

*Primary Examiner* — William E Dondero
*Assistant Examiner* — Diem Tran
(74) *Attorney, Agent, or Firm* — Harness, Dickey & Pierce, P.L.C.

(57) ABSTRACT

An elevator comprising
a hoistway;
an elevator car vertically movable in the hoistway;
a counterweight vertically movable in the hoistway;
at least one tightening wheel located in the lower end of the hoistway;
at least one rope wheel located in or at least in proximity of the upper end of the hoistway;
a first roping interconnecting the car and counterweight and passing around the at least one rope wheel located in or at least in proximity of the upper end of the hoistway;
a second roping interconnecting the car and counterweight and passing around the at least one tightening wheel, the tightening wheel being mounted movably back and forth in a first direction towards the second roping, and in a second direction away from the second roping; and
means for exerting force on the tightening wheel to move it in the first direction so as to tighten the second roping.
The elevator further comprises means for limiting the movement speed of the tightening wheel towards the first direction and the second direction.

11 Claims, 2 Drawing Sheets

(56) References Cited

U.S. PATENT DOCUMENTS

| | | | | | |
|---|---|---|---|---|---|
| 5,788,018 | A * | 8/1998 | Mendelsohn | B66B 11/08 | 187/266 |
| 7,481,299 | B2 * | 1/2009 | Mustalahti | B66B 7/10 | 187/264 |
| 7,806,237 | B2 * | 10/2010 | Aulanko | B66B 11/08 | 187/264 |
| 2016/0115002 | A1 * | 4/2016 | Sunderhaus | B66C 13/04 | 254/272 |

FOREIGN PATENT DOCUMENTS

| | | | | |
|---|---|---|---|---|
| JP | 05310382 | A | 11/1993 | |
| WO | WO 2010023350 | A1 * | 3/2010 | B66B 7/10 |

* cited by examiner

ELEVATOR

This application claims priority to European Patent Application No. EP14164857.6 filed on Apr. 16, 2014, the entire contents of which are incorporated herein by reference.

FIELD OF THE INVENTION

The invention relates to an elevator. The elevator is particularly meant for transporting passengers and/or goods.

BACKGROUND OF THE INVENTION

Elevators typically have a suspension roping between the elevator car and the counterweight which roping passes around a rope wheel mounted stationary in some suitable position above said elevator units. Additionally, the elevator may need to be provided with a second roping between the elevator car and the counterweight suspended to hang from the elevator car and the counterweight. This type of arrangement is normally used to provide compensation for the weight of the hoisting roping. Particularly, in this way the unbalance caused by the hoisting roping and occurring when the elevator car is run to its extreme position can be eliminated. The second roping can additionally or alternatively be used to provide a tie-down-function (also known as lock-down function). The second roping is generally tensioned to pass around a rope wheel mounted stationary in some suitable position below said elevator units, for instance in the lower end of the hoistway.

When an elevator car is parked at landing to unload and load, people tend to move within the car and between the car and the landing such that car load is uncontrollably changed. In particular, in these situations people are generally free to exit and enter the elevator car as they wish. In these situations more or less sudden vertical forces, often affecting the car in an impact-like manner, are exerted randomly on the elevator car. Correspondingly, sudden lightening of the load causes sudden changes in vertical forces exerted on the car.

Unless prevented, the sudden changes in vertical forces are likely to cause rapid stepwise movement of the car upwards or downwards, or even vertical swinging of the car. A drawback of the known elevators has been that this kind of rapid movement of the car caused during the loading and unloading has been difficult to eliminate simply and efficiently.

The second roping may be furthermore tensioned with a tensioning means, such as a tensioning weight. In a sudden increase of car load, the car is displaced downwards whereby the second roping is momentarily loosened. The tightening arrangement rapidly returns the higher tension level back to the second roping, whereby it urges the car to the same direction as the increased load.

The tie-down function, referred to above, is usually obtained by arranging the second roping to pass around a rope wheel. Considerable rising of the rope wheel in a case where the counterweight (or the car) accidentally comes to a sudden stop during a run of the elevator, is blocked and therefore the rope wheel can produce a support force for the loop of the second roping so it restricts the elevator car (or counterweight, respectively) from continuing its upwards directed movement, i.e. so called jumping is prevented. Such a sudden stop may be caused for example if during a run of the elevator the counterweight accidentally gets stuck on its guide rails or if the safety gear is activated, e.g. due to overspeed situation. These types of incidents would be harmful and dangerous, because they would cause sudden jerks for the people inside the car. One sort of a tie-down arrangement is disclosed in U.S. Pat. No. 2,270,441 A, for instance. The known tie-down devices generally react to extremely large one-directional shocks caused in the elevator roping system during an emergency, and they are not designed solve the problems of the loading and unloading situations. In particular, they are not suitable to act as means for removing up and down-directed fine-scale jerks caused in the car during a normal situation, when an elevator car is parked at landing for unloading and/or loading.

BRIEF DESCRIPTION OF THE INVENTION

The object of the invention is, inter alia, to solve previously described drawbacks of known solutions and problems discussed later in the description of the invention. The object of the invention is to introduce a new elevator which is improved in terms of its movement during loading and unloading of its car. Embodiments are presented, inter alia, where movement of the car during loading and unloading is reduced by controlling movement of the tightening wheel located in the lower end of the hoistway around which the second roping interconnecting the car and counterweight passes.

It is brought forward a new elevator, which comprises a hoistway, an elevator car vertically movable in the hoistway, a counterweight vertically movable in the hoistway and at least one tightening wheel located in the lower end of the hoistway. The elevator further comprises at least one rope wheel located in or at least in proximity of the upper end of the hoistway and a first roping interconnecting the car and counterweight and passing around the at least one rope wheel located in or at least in proximity of the upper end of the hoistway, and suspending the car and counterweight on opposite sides of said rope wheel. The elevator further comprises a second roping interconnecting the car and counterweight and passing around the at least one tightening wheel, the tightening wheel being mounted movably back and forth in a first direction towards the second roping, and in a second direction away from the second roping; and means for exerting force on the tightening wheel to move it in the first direction so as to tighten the second roping. The elevator further comprises means for limiting the movement speed of the tightening wheel towards the first direction and the second direction. Thereby said means are configured to allow movement of the tightening wheel towards the first direction with a limited speed as well as to allow movement of the tightening wheel towards the second direction with a limited speed. Said means thereby limit the movement speed of the tightening wheel towards the first and second direction without blocking movement towards these directions totally. As a consequence of limiting the movement speed of the tightening wheel towards the first direction, the risks of sudden movement of the car during a loading situation are substantially eliminated. A substantial part of the effects of the sudden increase in car load can thus be neutralized. Particularly a sudden stepwise sag of the car is thus eliminated. As a consequence of limiting the movement speed of the tightening wheel towards the second direction, on the other hand, the risks of sudden movement of the car during an unloading situation are substantially eliminated. A substantial part of the effects of the sudden increase in car load can thus be neutralized. Particularly a sudden stepwise lift of the car is thus eliminated. The slow response in movement (towards both of the two directions) facilitated by said limiting of the speed of the tightening wheel results in that undesired car movement can be neutralized in both of these directions, but also in that the tightening wheel can move slowly towards either one of the first direction and second direction, as optimal for the situation, such that tension in the second roping is maintained appropriate.

In a preferred embodiment said means for limiting the movement speed of the tightening wheel comprise a frame mounted in the hoistway and a hydraulic cylinder containing hydraulic fluid and being mounted between the frame and the tightening wheel, one of its piston part and cylinder part being attached to the frame, and the other of its piston part and cylinder part being attached to the tightening wheel, movement of the tightening wheel in said first direction being configured to cause a stroke of the hydraulic cylinder wherein the piston moves in the cylinder part in a first stroke direction, and movement of the tightening wheel in said second direction being configured to cause a stroke of the hydraulic cylinder wherein the piston moves in the cylinder part in a second stroke direction, and in that said means for limiting the movement speed comprise means for limiting stroke speed of the cylinder in the first and second stroke direction. One benefit of the disclosed system is that it can simply provide the function of reducing car movement during loading and unloading without electrical devices. A further benefit of the disclosed system is that it can work continuously, meaning that hydraulic pressure can keep stabilizing all the time reacting to changes in tension force of the second roping. Stabilization speed can be selected by adjusting the flow control valve, i.e. by adjusting the size of the orifice through which hydraulic fluid flows during stroke of the cylinder. The solution described can be used in parallel with other devices such as a lock-down device.

In a preferred embodiment the means for limiting stroke speed of the cylinder comprises a conduit system for allowing passage of hydraulic fluid to and from the hydraulic chamber during strokes of the hydraulic cylinder connected with an opening in the hydraulic chamber delimited by the piston part and the cylinder part, and one or more adjustable flow control valves in the conduit system, and in that each of the stroke in said first direction and the stroke in the second stroke direction is arranged to a change the volume of the hydraulic chamber, and to displace an amount of hydraulic fluid through said opening and through at least one of said adjustable flow control valves, which amount is equal to the amount of change of the volume of the hydraulic chamber during the stroke, the flow rate of hydraulic fluid into (during a stroke in one of the first and second stroke direction) and out of (during a stroke in the other of the first and second stroke direction) the hydraulic chamber through said opening being thereby limited by said at least one adjustable flow control valve. Thereby the stroke speed of the cylinder during each stroke is adjustably limited. With this configuration, the stroke speeds are easy to adjust. The hydraulic system is hereby also simple to dimension, implement and service.

In a preferred embodiment the means for limiting stroke speed of the cylinder comprises a conduit system for allowing passage of hydraulic fluid into (during a stroke in one of the first and second stroke direction) and out from (during a stroke in the other of the first and second stroke direction) hydraulic chamber, connected with an opening in a hydraulic chamber delimited by the piston and the cylinder, and one or more adjustable flow control valves in the conduit system, and in that a stroke in said first stroke direction is arranged to a change the volume of the hydraulic chamber, and to displace an amount of hydraulic fluid through said opening and a first adjustable flow control valve, which amount is equal to the amount of change of the volume of the hydraulic chamber during the stroke, and in that a stroke in said second stroke direction is arranged to a change the volume of the hydraulic chamber, and to displace an amount of hydraulic fluid through said opening and a second adjustable flow control valve, which amount is equal to the amount of change of the volume of the hydraulic chamber during the stroke, the flow rate of hydraulic fluid into (during a stroke in one of the first and second stroke direction) and out of (during a stroke in the other of the first and second stroke direction) the hydraulic chamber through said opening being thereby limited by different adjustable flow control valves. Thereby the stroke speed of the cylinder in each stroke direction is limited individually adjustable.

In a preferred embodiment said means for limiting the stroke speed of said stroke comprise an opening in a hydraulic chamber of the cylinder; a first conduit connected with the opening for allowing passage of the hydraulic fluid to enter the hydraulic chamber during a stroke of the hydraulic cylinder in one of the first and second stroke direction; a second conduit connected with the opening, for allowing passage of the hydraulic fluid to exit the hydraulic chamber during a stroke in the other of the first and second stroke direction; and in the first conduit a one-way valve arranged to allow flow through the first conduit into the hydraulic chamber and to block flow in the opposite direction, and a first adjustable flow control valve delimiting the flow rate of hydraulic fluid into the hydraulic chamber during a stroke of the hydraulic cylinder in said one of the first and second stroke direction; and in the second conduit a one-way valve arranged to allow flow through the second conduit from the hydraulic chamber and to block flow in the opposite direction, and a second adjustable flow control valve delimiting the flow rate of the hydraulic fluid away from the hydraulic chamber during a stroke of the hydraulic cylinder in said other of the first and second stroke direction.

In a preferred embodiment the means for limiting stroke speed of the cylinder comprises a conduit system for allowing passage of hydraulic fluid to or from the hydraulic chamber during said stroke of the hydraulic cylinder connected with an opening in a hydraulic chamber delimited by the piston and the cylinder, and an adjustable flow control valve in the conduit system, and in that each of the stroke in said first direction and the stroke in the second stroke direction is arranged to a change the volume (increase or decrease) of the hydraulic chamber, and to displace an amount of hydraulic fluid through said opening and said adjustable flow control valve, which amount is equal to the amount of change of the volume of the hydraulic chamber during the stroke, the flow rate of hydraulic fluid into the hydraulic chamber during a stroke in one of the first and second stroke direction, and the flow rate of hydraulic fluid into the hydraulic chamber during a stroke in the other of the first and second stroke direction being thereby limited by said (same) flow control valve. Thereby, the stroke speed of the cylinder during each stroke is adjustably limited. The hydraulic system is hereby also simple to implement and service.

In a preferred embodiment said means for limiting the stroke speed of said stroke comprise an opening in the hydraulic chamber of the cylinder; a conduit, connected with the opening, for allowing passage of the hydraulic fluid to enter the hydraulic chamber during a stroke of the hydraulic cylinder in first stroke direction and for allowing passage of the hydraulic fluid to exit the hydraulic chamber during a stroke in the second stroke direction; and in the conduit an adjustable flow control valve delimiting the flow rate of hydraulic fluid into the hydraulic chamber during a stroke of the hydraulic cylinder in one of the first and second stroke direction, and delimiting the flow rate of the hydraulic fluid away from the hydraulic chamber during a stroke of the hydraulic cylinder in the other of the first and second stroke direction.

In a preferred embodiment said hydraulic chamber is a closed space apart from said opening.

In a preferred embodiment said means for exerting force on the tightening wheel are arranged to continuously exert said force on the tightening wheel.

In a preferred embodiment said means for exerting force on the tightening wheel comprise a spring arranged to continuously urge the tightening wheel towards the first direction by its spring force.

In a preferred embodiment said spring is a compression spring arranged to push the tightening wheel towards first direction by its spring force.

In a preferred embodiment said means for exerting force on the tightening wheel to move the tightening wheel towards tightening direction comprise a weight arranged to urge (push or pull) the tightening wheel towards the first direction by its weight.

The frame is preferably mounted in the hoistway immovably relative to the hoistway. Furthermore, it is preferable that the hydraulic cylinder is mounted between the frame and the tightening wheel such that one of the piston and cylinder is attached to the frame immovably relative to the frame at least in the stroke direction of the cylinder and the other is movable relative to the frame and attached on the tightening wheel.

The elevator referred to is preferably, but not necessarily, installed inside a building. The car is preferably arranged to move vertically and serve two or more landings. The car is preferably arranged to respond to calls from landing(s) and/or destination commands from inside the car so as to serve persons on the landing(s) and/or inside the elevator car. Preferably, the car has an interior space suitable for receiving a passenger or passengers.

BRIEF DESCRIPTION OF THE DRAWINGS

In the following, the present invention will be described in more detail by way of example and with reference to the attached drawings, in which.

DETAILED DESCRIPTION

Figure 1:
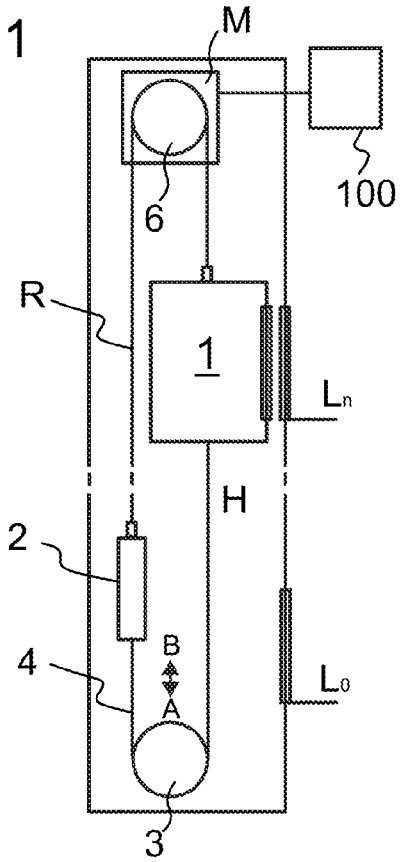
FIG. 1 illustrates schematically a side view of an elevator according to a preferred embodiment of the invention.

FIG. 1 illustrates an elevator according to a preferred embodiment. The elevator comprises a hoistway H, an elevator car 1 and a counterweight 2 vertically movable in the hoistway H, and a drive machine M, which provides moving force for the elevator car 1 under control of an elevator control system 100. The elevator furthermore comprises landings $L_0$-$L_n$, where the elevator car is arranged to visit for unloading passengers and/or loading passengers.

The car 1 and counterweight 2 are interconnected by a first roping R, i.e. a suspension roping R, which passes around at least one rope wheel 6 located in or at least in proximity of the upper end of the hoistway H suspending the car 1 and counterweight 2 on opposite sides of the rope wheel 6.

The elevator further comprises at least one tightening wheel 3 located in the lower end of the hoistway H, and a second roping 4 interconnecting the car 1 and counterweight 2 and passing around the at least one tightening wheel 3. The tightening wheel is mounted movably back and forth in a first direction A towards the second roping 4, and in a second direction B away from the second roping 4. Movement in the first direction A tightens the second roping 4 and movement in the second direction loosens the roping. The elevator further comprises means 5,5' for exerting a force on the tightening wheel 3 to move it in the first direction A so as to tighten the roping. Said means may be in the form of a spring 5 or a weight 5' or a combination of these, for example. The elevator further comprises means (F,6,7,10,12;F,6',7,10',12'; F,6*a*,6*b*,7,10', 12*a*,12*b*;F,6*a*',6*b*', 7,12*a*',12*b*') for limiting the movement speed of the tightening wheel 3 towards the first direction A and the second direction B, whereby said means (F,6,7,10,12;F,6',7,10',12';F,6*a*,6*b*,7,10',12*a*,12*b*; F,6*a*',6*b*',7, 12*a*',12*b*') are configured to allow movement of the tightening wheel 3 towards the first direction A with a limited speed as well as to allow movement of the tightening wheel 3 towards the second direction B with a limited speed. Said means thereby limit the movement speed of the tightening wheel 3 towards the first direction A and second direction B without blocking the movement towards these directions totally. FIGS. 2*a*, 2*b*, 3*a* and 3*b* illustrate preferred embodiments for the means (F,6,7,10,12; F,6',7,10',12';F,6*a*,6*b*,7, 10',12*a*,12*b*;F,6*a*',6*b*',7,12*a*',12*b*') for limiting the movement speed of the tightening wheel 3 towards the first direction A and the second direction B.

As a consequence of limiting the movement speed of the tightening wheel 3 towards the first direction A, the risks of sudden movement of the car during a loading situation are substantially eliminated. The car normally starts to react to a sudden increase in car load during a loading situation by a downswing. The tension of the second roping 4 decreases due to the car movement, which would normally be right away reacted to by the tightening means. In the preferred embodiment, however, the movement speed of the tightening wheel 3 towards the first direction A is limited, and the tightening wheel 3 is not able to rapidly move towards direction A to tighten the second roping 4. Such a rapid response of the tightening wheel 3 would increase the forces urging the car 1 downwards thereby working for the downswing. Due to this kind of slow response, the tension is not rapidly recovered, but the tension remains at a considerably lower level longer than it would in a system allowing unlimited movement speed for the tightening wheel 3. A substantial part of the effects of the sudden increase in car load can thus be neutralized. Particularly a sudden stepwise sag of the car 1 is thus eliminated. Such a stepwise sag, typically in the range of 0.2 to 1 cm, would be inconvenient for the passengers but could also be harmful for a sensitive objects being transported.

As a consequence of limiting the movement speed of the tightening wheel 3 towards the second direction B, on the other hand, the risks of sudden movement of the car 1 during an unloading situation are substantially eliminated. The car 1 normally starts to react to a sudden decrease in car load during a loading situation by an upswing. The tension of the roping R pulls the lightened car 1 upwards. Movement of the car 1, however, cannot take place unless the second roping 4 is pulled upwards along with the car 1. In the preferred embodiment, the movement speed of the tightening wheel 3 towards the first direction B is limited, whereby the tightening wheel 3 is not able to rapidly move towards direction B to allow the second roping 4 to rapidly allow movement of the car 1 upwards. Due to this kind of slow response, the tension in the second roping 4 is temporarily increased, and the increased tension is maintained considerably longer than it would in a system allowing unlimited movement speed for the tightening wheel 3. A substantial part of the effects of the sudden increase in car load can thus be neutralized. Particularly a sudden stepwise lift of the car 1 is thus eliminated. Such a stepwise lift, typically in the range of 0.2 to 1 cm, would be inconvenient for the passengers but could also be harmful for a sensitive objects being transported.

The slow response in movement towards direction A or B facilitated by said limiting of the speed of the tightening wheel 3 results in that the undesired car movement can be neutralized in both of these directions, but also in that the tightening wheel 3 can move slowly towards either one of the first direction A and second direction B, as optimal for the situation, such that tension in the second roping 4 is maintained appropriate.

In FIGS. 2*a*, 2*b*, 3*a* and 3*b* preferred embodiments for the means (F,6,7,10,12;F,6',7,10',12';F,6*a*,6*b*,7,10',12*a*,12*b*;F, 6*a*',6*b*',7,12*a*',12*b*') for limiting the movement speed of the tightening wheel 3 towards the first direction A and the second direction B are shown. Said means for limiting the movement speed of the tightening wheel comprise a frame F mounted in the hoistway H and a hydraulic cylinder 7 containing hydraulic fluid and being mounted between the frame and the tightening wheel 4, one of its piston part 8 and cylinder part 9 being attached to the frame F, and the other of its piston part 8 and cylinder part 9 being attached to the tightening wheel 3. In the embodiment shown, the cylinder part 9 is attached to the tightening wheel 3. The attachment point can be the shaft or shaft supporting frame structure of the tightening wheel 3, for example. Movement of the tightening wheel 3 in said first direction A is configured to cause a stroke of the hydraulic cylinder 7 wherein the piston 8 moves in the cylinder part 9 in a first stroke direction, and movement of the tightening wheel 3 in said second direction B being configured to cause a stroke of the hydraulic cylinder 7 wherein the piston 8 moves in the cylinder part 9 in a second stroke direction. Said means for limiting the movement speed comprise means 6,10,12; 6',10',12';6*a*,6*b*, 10',12*a*,12*b*;6*a*',6*b*',12*a*',12*b*' for limiting stroke speed of the cylinder 7 in the first and second stroke direction The means 6,10,12; 6',10',12';6*a*,6*b*,10',12*a*,12*b*;6*a*',6*b*', 12*a*',12*b*' for limiting stroke speed of the cylinder 7 comprises a conduit system 12;12*a*,12*b* for allowing passage of hydraulic fluid to and from the hydraulic chamber 11;11' during strokes of the hydraulic cylinder 7 connected with an opening 10 formed in the hydraulic chamber 11;11', which is sealedly closed space apart from said opening 10;10'. The hydraulic chamber 11;11' is delimited by the piston part 8 and the cylinder part 9. The means 6,10,12; 6',10',12';6*a*,6*b*, 10',12*a*,12*b*; 6*a*',6*b*',12*a*',12*b*' for limiting stroke speed of the cylinder 7 further comprise one or more adjustable flow control valves 6;6';6*a*,6*b*;6*a*',6*b*' in the conduit system 12;12';12*a*,12*b*;12*a*',12*b*'. In each of the stroke in said first direction and the stroke in the second stroke direction the head of the piston part 9 moves relative to the cylinder such that the volume (increase or decrease) of the hydraulic chamber 11 is changed change. Each stroke is arranged to displace an amount of hydraulic fluid through said opening 10 and through at least one of said one or more adjustable flow control valves 6;6';6*a*,6*b*;6*a*',6*b*', which amount is equal to the amount of change of the volume of the hydraulic chamber 11;11' during the stroke, the flow rate of hydraulic fluid into (during a stroke in one of the first and second stroke direction) and out of (during a stroke in the other of the first and second stroke direction) the hydraulic chamber through said opening 10;10' being thereby limited by said at least one adjustable flow control valve 6;6;6*a*,6*b*;6*a*',6*b*'. Thereby the stroke speed of the cylinder 7 during each stroke is adjustably limited. Hereby, the stroke speeds are easy to adjust. The hydraulic system is hereby also simple to implement and service.

Figure 2A:
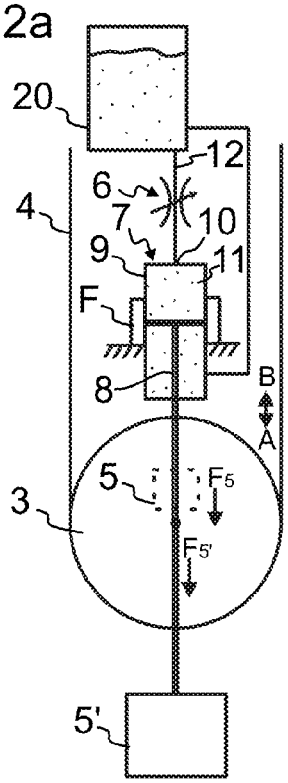
FIGS. 2*a* and 2*b* illustrate each an embodiment for the means for limiting the movement speed of the tightening wheel towards the first direction and the second direction.
Figure 2B:
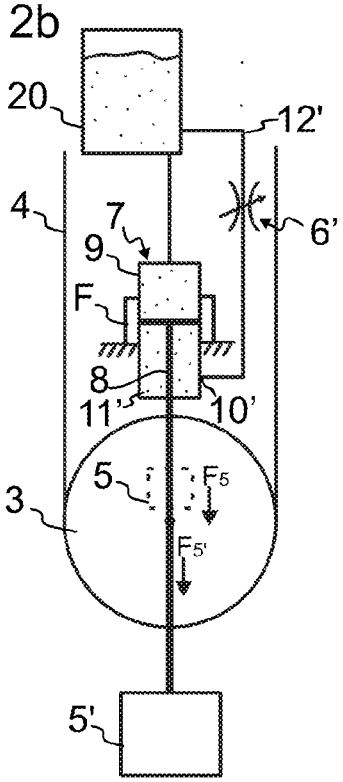

In the embodiments of FIGS. 2*a* and 2*b* the hydraulic fluid is moved via the same route in the strokes towards first stroke direction and the second stroke direction. The means 6,10,12; 6',10',12' for limiting stroke speed of the cylinder 7 comprises a conduit system 12:12' for allowing passage of hydraulic fluid to or from the hydraulic chamber 11;11' during said stroke of the hydraulic cylinder is connected with an opening 10;10' in a hydraulic chamber delimited by the piston and the cylinder, and an adjustable flow control valve in the conduit system, and in that each of the stroke in said first stroke direction and the stroke in the second stroke direction is arranged to a change the volume (increase or decrease) of the hydraulic chamber, and to displace an amount of hydraulic fluid through said opening 10;10' and said adjustable flow control valve, which amount is equal to the amount of change of the volume of the hydraulic chamber during the stroke, the flow rate of hydraulic fluid into the hydraulic chamber (11;11') during a stroke in one of the first and second stroke direction, and the flow rate of hydraulic fluid out of the hydraulic chamber (11;11') during a stroke in the other of the first and second stroke direction being thereby limited by said same flow control valve 6;6'. Thereby the stroke speed of the cylinder 7 during each stroke is adjustably limited in a simple fashion.

The embodiments of FIGS. 2*a* and 2*b* are alternative to each other and otherwise similar but the hydraulic chamber 11;11' having the opening 10;10' wherein the conduit system 12;12' is connected to are on opposite sides of the piston part 8. In the embodiment of FIG. 2*a*, the piston draws hydraulic fluid through said conduit system 12 during the stroke in first direction and pushes hydraulic fluid through said conduit system 12, particularly through the adjustable valve 6 during a stroke in second direction. In the embodiment of FIG. 2*b*, the piston 8 pushes hydraulic fluid through said conduit system 12' during the stroke in first direction and pushes hydraulic fluid through said conduit system 12', particularly through the adjustable valve 6', during a stroke in second direction. In these embodiments, the conduit system 12;12' is between a hydraulic tank 20 and the opening 10;10'.

Figure 3A:
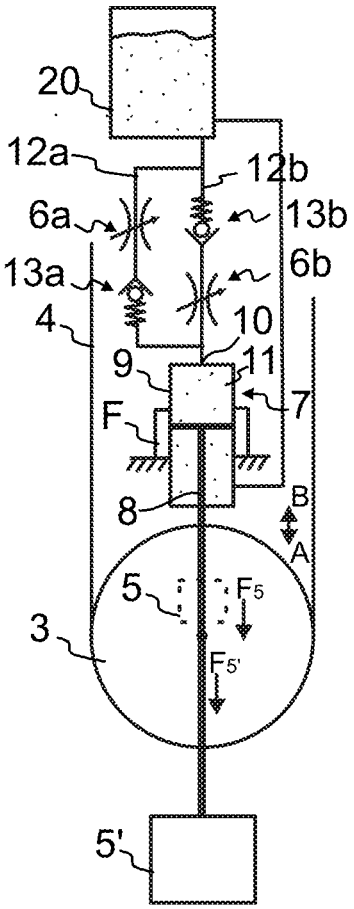
FIGS. 3*a* and 3*b* illustrate each an embodiment for the means for limiting the movement speed of the tightening wheel towards the first direction and the second direction.
Figure 3B:
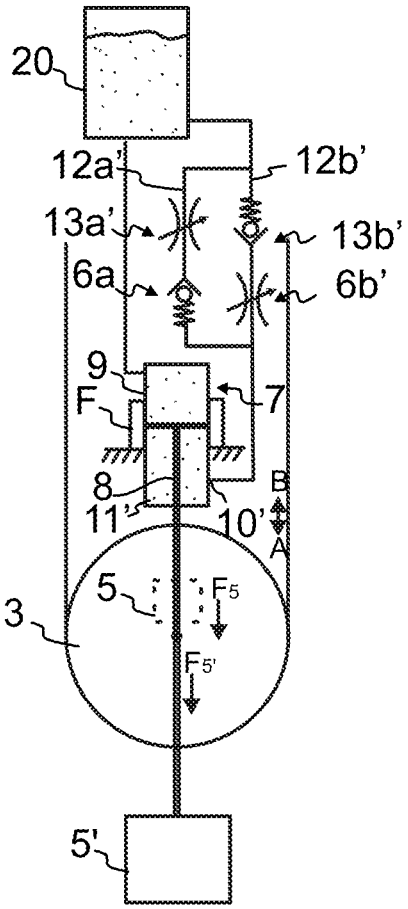

In the embodiments of FIGS. 3*a* and 3*b* the hydraulic fluid is moved via different routes in the strokes towards first stroke direction and the second stroke direction. In these embodiments, the means 6*a*,6*b*,10',12*a*,12*b*;6*a*',6*b*',12*a*',12*b*' for limiting stroke speed of the cylinder 7 comprises a conduit system 12*a*,12*b*;12*a*',12*b*' for allowing passage of hydraulic fluid into (during a stroke in one of the first and second stroke direction) and out of (during a stroke in the other of the first and second stroke direction) hydraulic chamber 11;11'. The conduit system 12*a*,12*b*;12*a*',12*b*' is connected with an opening 10,10' in a hydraulic chamber delimited by the piston 8 and the cylinder 9, and adjustable flow control valves 6*a*,6*b*;6*a*',6*b*' in the conduit system 12*a*,12*b*;12*a*',12*b*', and in that a stroke in said first stroke direction is arranged to a change the volume (increase or decrease) of the hydraulic chamber, and to displace an amount of hydraulic fluid through said opening 10 and a first adjustable flow control valve 6*a*;6*a*', which amount is equal to the amount of change of the volume of the hydraulic chamber 11;11' realized during the stroke, and in that a stroke in said second stroke direction is arranged to a change the volume (increase or decrease) of the hydraulic chamber 11;11', and to displace an amount of hydraulic fluid through said opening 10;10' and a second adjustable flow control valve 6*b*;6*b*', which amount is equal to the amount of change of the volume of the hydraulic chamber 11;11' realized during the stroke, the flow rate of hydraulic fluid into (during a stroke in one of the first and second stroke direction) and out from (during a stroke in the other of the first and second stroke direction) the hydraulic chamber through said opening 10;10' being thereby limited by different adjustable flow control valves 6*a*,6*b*;6*a*',6*b*'. Thereby the stroke speed of the cylinder in each stroke direction is limited individually adjustably.

More particularly, said means 6*a*,6*b*,10',12*a*,12*b*;6*a*',6*b*', 12*a*',12*b*' for limiting the stroke speed of said stroke comprise an opening 10,10' in the hydraulic chamber 11;11' of the cylinder 7, which hydraulic chamber 11;11' is a closed space apart from said opening 10;10'. That is, no other openings lead out from it. Said means further comprise a first conduit 12*a*;12*a*', connected with the opening 10,10' for allowing passage of the hydraulic fluid to enter the hydraulic chamber 11,11' during a stroke of the hydraulic cylinder 7 in one (in FIG. 3*a* first stroke direction, down) of the first and second stroke direction, and a second conduit 12*b*;12*b*' connected with the opening 10;10' for allowing passage of the hydraulic fluid to exit the hydraulic chamber 11;11' during a stroke in the other (in FIG. 3*a* second stroke direction, up) of the first and second stroke direction, and in the first conduit 12*a*;12*a*' a one-way valve 13*a*;13*a*' arranged to allow flow through the first conduit 12*a*,12*a*' into the hydraulic chamber and to block flow in the opposite direction, and a first adjustable flow control valve 6*a* delimiting the flow rate of hydraulic fluid into the hydraulic chamber 11;11' during a stroke of the hydraulic cylinder 7 in said one of the first and second stroke direction, and in the second conduit 12*b*;12*b*' a one-way valve 13*b*;13*b*' arranged to allow flow through the second conduit 12*b*;12*b*' from the hydraulic chamber 11,11' and to block flow in the opposite direction, and a second adjustable flow control valve 6*b*;6*b*' delimiting the flow rate of the hydraulic fluid away from the hydraulic chamber 11;11' during a stroke of the hydraulic cylinder 7 in said other of the first and second stroke direction.

The embodiments of FIGS. 3*a* and 3*b* are alternative to each other and otherwise similar but their hydraulic chambers 11;11' having the opening 10;10' wherein the conduit system 12*a*,12*b*;12*a*',12*b*' is connected to are on opposite sides of the piston part 8. In the embodiment of FIG. 3*a*, the piston draws hydraulic fluid through the branch 12*a* of said conduit system 12*a*,12*b*, particularly through adjustable valve 6*a* and the one-way valve 13*a*, during the stroke in first direction, and the piston part 8 pushes hydraulic fluid through the branch 12*b* of said conduit system 12*a*,12*b*, particularly through adjustable valve 6*b* and the one-way valve 13*b* during the stroke in the second direction. In the embodiment of FIG. 3*b*, the piston part 8 pushes hydraulic fluid through the branch 12*b*' of said conduit system 12*a*', 12*b*', particularly through adjustable valve 6*b*' and the one-way valve 13*b*', during the stroke in first direction, and the piston part 8 draws hydraulic fluid through the branch 12*a*' of said conduit system 12*a*',12*b*', particularly through adjustable valve 6*a*' and the one-way valve 13*a*' during the stroke in the second direction. In these embodiments, the conduit system 12*a*,12*b*;12*a*',12*b*' is between a hydraulic tank 20 and the opening 10;10'.

Figure 4:
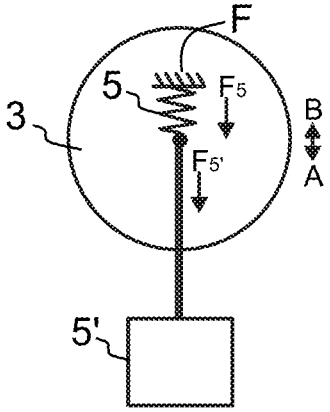
FIG. 4 illustrates preferred details for the means for exerting force on the tightening wheel to move it in the first direction so as to tighten a roping of the elevator.

As illustrated in FIGS. 2*a* to 4 the elevator comprises means 5,5' for exerting a force on the tightening wheel 3 to move it in the first direction A so as to tighten the roping. Said means 5,5' for exerting force $F_5$,$F_{5'}$ on the tightening wheel are arranged to continuously exert said force on the tightening wheel 3, i.e. all the time when the elevator is in use. Said means may comprise a spring 5 or a weight 5' or comprise both of these, as illustrated. FIG. 4 illustrated further details of the means 5,5' for exerting a force on the tightening wheel 3. Said means comprise in this case a spring 5 arranged to continuously urge the tightening wheel 3 towards the first direction A by its spring force $F_5$. The spring 5 is preferably a compression spring 5 arranged to push the tightening wheel towards tightening direction by its spring force $F_5$, as illustrated. In this case, it is preferably mounted between the frame F and the diverting wheel 3. Additionally, it is preferable, but not necessary that said means 5,5' for exerting force $F_5$,$F_{5'}$ on the tightening wheel 3 to move the tightening wheel towards tightening direction comprise a weight 5' arranged to urge the tightening wheel 3 towards the first direction A by its weight $F_{5'}$, i.e. force generated on the weight 5' by force of gravity.

The frame F is preferably mounted in the hoistway H immovably relative to the hoistway H. Furthermore, as illustrated, it is preferable that the hydraulic cylinder is mounted between the frame F and the tightening wheel 3 such that one of the piston and cylinder is attached to the frame F immovably relative to the frame F at least in the stroke direction of the cylinder and the other is movable relative to the frame F and attached on the tightening wheel 3, such as on the shaft or shaft supporting frame structure of the tightening wheel 3.

The adjustable flow control valve 6;6';6*a*,6*b*;6*a*',6*b*' particularly has an adjustable flow rate. Preferably, for this purpose it has a flow orifice the size is of which is adjustable. The adjustable flow control valve 6;6';6*a*,6*b*;6*a*',6*b*' may be in the form of a so called adjustable choke valve for instance wherein the flow orifice size is adjustable, for instance a so called needle valve.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator comprising:

an elevator car configured to move vertically in a hoistway;

a counterweight configured to move vertically in the hoistway;

at least one rope wheel located at least in proximity of an upper end of the hoistway;

a first roping interconnecting the elevator car and the counterweight and passing around the at least one rope wheel located at least in proximity of the upper end of the hoistway;

at least one tightening wheel located in a lower end of the hoistway;

a second roping interconnecting the elevator car and the counterweight and passing around the at least one tightening wheel, the at least one tightening wheel being mounted movably back and forth in a first direction towards the second roping and in a second direction away from the second roping;

an urging device configured to exert a force on the at least one tightening wheel to move the at least one tightening wheel in the first direction so as to tighten the second roping; and a variable speed limiting device configured to variably limit a movement speed of the at least one tightening wheel towards the first direction and the second direction, the variable speed limiting device including, a hydraulic cylinder containing hydraulic fluid, the hydraulic cylinder being mounted between a frame and the at least one tightening wheel, the hydraulic cylinder including a piston part and a cylinder part delineating a hydraulic chamber in the hydraulic cylinder, the piston part being configured to move relative to the cylinder part in a first stroke direction in response to the at least one tightening wheel moving in the first direction, and to move relative to the cylinder part in a second stroke direction in response to the at least one tightening wheel moving in the second direction, such that a volume of the hydraulic chamber changes during strokes of the hydraulic cylinder, and a stroke speed limiter configured to variably limit a speed of the strokes of the hydraulic cylinder in both of the first and second stroke direction, the stroke speed limiter including a conduit system connected with the hydraulic chamber, the conduit system being configured to allow passage of the hydraulic fluid into and out from the hydraulic chamber through a same opening formed in the hydraulic chamber, the conduit system including one or more adjustable flow control valves configured to variably limit a rate at which an amount of the hydraulic fluid equal to an amount of change of the volume of the hydraulic chamber flows into the hydraulic chamber during a stroke in one of the first and second stroke direction, and flows out from the hydraulic chamber during a stroke in the other of the first and second stroke direction, through the same opening and at least one of the one or more adjustable flow control valves.

2. The elevator according to claim 1, wherein the one or more adjustable flow control valves include a plurality of adjustable flow control valves, the plurality of adjustable flow control valves including, a first adjustable flow control valve configured to variably limit the rate at which the amount of the hydraulic fluid equal to the amount of change of the volume of the hydraulic chamber flows into the hydraulic chamber through the same opening and the first adjustable flow control valve when the volume of the hydraulic chamber increases during a stroke of the hydraulic cylinder in said first stroke direction, and a second adjustable flow control valve configured to variably limit the rate at which the amount of the hydraulic fluid equal to the amount of change of the volume of the hydraulic chamber flows out from the hydraulic chamber through the same opening and the second adjustable flow control valve when the volume of the hydraulic chamber decreases during a stroke of the hydraulic cylinder in said second stroke direction.

3. The elevator according to claim 1, wherein the conduit system includes, a first conduit connected with the same opening, the first conduit being configured to allow the hydraulic fluid to enter the hydraulic chamber during a stroke of the hydraulic cylinder in one of the first and second stroke direction, the first conduit including, a first one-way valve configured to allow flow of the hydraulic fluid through the first conduit into the hydraulic chamber and to block flow of the hydraulic fluid in an opposite direction, and a first adjustable flow control valve configured to variably limit the rate at which the hydraulic fluid flows into the hydraulic chamber during the stroke in said one of the first and second stroke direction, and a second conduit connected with the same opening, the second conduit being configured to allow the hydraulic fluid to exit the hydraulic chamber during a stroke of the hydraulic cylinder in the other of the first and second stroke direction, the second conduit including, a second one-way valve configured to allow flow of the hydraulic fluid through the second conduit out from the hydraulic chamber and to block flow of the hydraulic fluid in an opposite direction, and a second adjustable flow control valve configured to variably limit the rate at which the hydraulic fluid flows out from the hydraulic chamber during the stroke in the other of the first and second stroke direction.

4. The elevator according to claim 1, wherein the one or more adjustable control valves is a single adjustable flow control valve.

5. The elevator according to claim 1, wherein the conduit system includes a conduit, connected with the same opening formed in the hydraulic chamber, configured to allow the hydraulic fluid to enter the hydraulic chamber through the same opening during a stroke of the hydraulic cylinder in the first stroke direction and to allow the hydraulic fluid to exit the hydraulic chamber through the same opening during a stroke of the hydraulic cylinder in the second stroke direction, and wherein the one or more adjustable flow control valves is a single adjustable flow control valve included in the conduit.

6. The elevator according to claim 1, wherein the urging device is configured to continuously exert said force on the at least one tightening wheel.

7. The elevator according to claim 1, wherein the urging device includes a weight configured to urge the at least one lightening wheel towards the first direction by a weight force.

8. The elevator according to claim 1, wherein the urging device includes a spring configured to continuously urge the at least one tightening wheel towards the first direction by a spring force.

9. The elevator according to claim 8, wherein said spring is a compression spring configured to push the at least one tightening wheel towards the first direction by the spring force.

10. An elevator control device configured to control movement of a tightening wheel in a first direction and a second direction, the tightening wheel being located at a lower end of a hoistway, the lightening wheel being configured to move a roping interconnecting an elevator car and a counterweight, the elevator control device comprising:

an urging device configured to exert a force on the tightening wheel to move the tightening wheel in the first direction so as to tighten the roping; and a variable speed limiting device configured to variably limit a movement speed of the tightening wheel in both of the first direction and the second direction, the variable speed limiting device including, a hydraulic cylinder containing hydraulic fluid, the hydraulic cylinder being mounted between a frame and the tightening wheel, the hydraulic cylinder including a piston part and a cylinder part delineating a hydraulic chamber in the hydraulic cylinder, the piston part being configured to move in the cylinder part in a first stroke direction in response to the tightening wheel moving in the first direction, and to move in the cylinder part in a second stroke direction in response to the tightening wheel moving in the second direction, such that a volume of the hydraulic chamber changes during strokes of the hydraulic cylinder, and a stroke speed limiter configured to variably limit a speed of the strokes of the hydraulic cylinder in both of the first and second stroke direction, the stroke speed limiter including a conduit system connected with the hydraulic chamber, the conduit system being configured to allow passage of the hydraulic fluid into and out from the hydraulic chamber through a same opening formed in the hydraulic chamber, the conduit system including one or more adjustable flow control valves configured to variably limit a rate at which an amount of the hydraulic fluid equal to an amount of change of the volume of the hydraulic chamber flows into the hydraulic chamber during a stroke in one of the first and second stroke direction, and flows out from the hydraulic chamber during a stroke in the other of the first and second stroke direction, through the same opening and at least one of the one or more adjustable flow control valves.

11. The elevator control device of claim 10, wherein the one or more adjustable flow control valves include a plurality of adjustable flow control valves, the plurality of adjustable flow control valves including, a first adjustable flow control valve configured to variably limit the rate at which the amount of the hydraulic fluid equal to the amount of change of the volume of the hydraulic chamber flows through the same opening and the first adjustable control valve when the volume of the hydraulic chamber increases during a stroke in the first stroke direction, and a second adjustable flow control valve configured to variably limit the rate at which the amount of the hydraulic fluid equal to the amount of change of the volume of the hydraulic chamber flows through the same opening and the second adjustable flow control valve when the volume of the hydraulic chamber decreases during a stroke in the second stroke direction.

* * * * *